US005606406A

United States Patent [19]

Ikeyama et al.

[11] Patent Number: 5,606,406

[45] Date of Patent: Feb. 25, 1997

[54] PROCESS CARTRIDGE PROVIDED WITH AN ACCURATELY POSITIONED TRANSFER ROLLER

[75] Inventors: Takuzou Ikeyama; Mitsuru Yamazaki; Masaru Takusagawa, all of Kawasaki, Japan

[73] Assignee: Fujitsu Limited, Kawasaki, Japan

[21] Appl. No.: 103,785

[22] Filed: Aug. 10, 1993

[30] Foreign Application Priority Data

Sep. 28, 1992 [JP] Japan ..... 4-257926

[51] Int. Cl.[6] ..... G03G 21/16

[52] U.S. Cl. ..... 399/111; 399/130

[58] Field of Search ..... 355/200, 210, 355/211, 271, 276, 277; 361/221; 384/419, 439

[56] References Cited

U.S. PATENT DOCUMENTS

| | | | |
|---|---|---|---|
| 2,391,272 | 12/1945 | Rose | 384/419 X |
| 3,002,792 | 10/1961 | Sekulski | 384/419 |
| 3,053,368 | 9/1962 | Klahn | 384/419 X |
| 4,257,700 | 3/1981 | Tsuda et al. | 355/271 X |
| 4,386,838 | 6/1983 | Hirabayashi et al. | 355/200 |
| 4,456,363 | 6/1984 | Hirabayashi | 355/317 |
| 4,609,276 | 9/1986 | Mitzutani . | |
| 4,681,422 | 7/1987 | Oba et al. | 355/309 |
| 4,754,293 | 6/1988 | Aizawa et al. | 355/309 X |
| 4,875,077 | 10/1989 | Takamatsu et al. | 355/271 X |
| 5,136,329 | 8/1992 | Sugiura | 355/200 X |
| 5,371,575 | 12/1994 | Sekino et al. | 355/210 |

FOREIGN PATENT DOCUMENTS

| | | |
|---|---|---|
| 0232064 | 1/1987 | European Pat. Off. . |
| 0247602 | 5/1987 | European Pat. Off. . |
| 0376617 | 12/1989 | European Pat. Off. . |
| 0487039 | 11/1991 | European Pat. Off. . |
| 0590940 | 9/1993 | European Pat. Off. . |
| 0590941 | 9/1993 | European Pat. Off. . |
| 4315785A1 | 11/1993 | Germany . |
| 56-126876 | 10/1981 | Japan . |
| 60-166960 | 8/1985 | Japan . |
| 61-56371 | 3/1986 | Japan . |
| 63-123059 | 5/1988 | Japan . |
| 63-199369 | 8/1988 | Japan . |
| 63-210856 | 9/1988 | Japan . |
| 1-7047 | 1/1989 | Japan . |
| 1-42662 | 2/1989 | Japan . |
| 2-148076 | 6/1990 | Japan . |
| 3100665 | 4/1991 | Japan . |
| 4140759 | 5/1992 | Japan . |
| 5045951 | 2/1993 | Japan . |

*Primary Examiner*—Nestor R. Ramirez
*Attorney, Agent, or Firm*—Staas & Halsey

[57] ABSTRACT

An image forming apparatus has an exchangeable process cartridge which transfers a toner image from a latent image carrier onto a sheet. The process cartridge includes a frame; an endless latent image carrier provided on the frame; a charger provided on the frame for charging the latent image carrier; a transfer roller rotatably provided at a portion of the frame which faces the latent image carrier; and a cover for the transfer roller having guide ribs which guide a paper sheet. The transfer roller transfers a toner image from the latent image carrier onto a sheet. The image forming apparatus includes an endless latent image carrier; a latent image forming unit forming an electrostatic latent image on the latent image carrier; a developing unit for developing the electrostatic latent image on the latent image carrier; a transfer roller for transferring a toner image from the latent image carrier onto a sheet; and a process cartridge having a protection cover member for rotatably supporting at least the latent image carrier on a frame and rotatably holding the transfer roller opposing the latent image carrier.

30 Claims, 11 Drawing Sheets

PROCESS CARTRIDGE PROVIDED WITH AN ACCURATELY POSITIONED TRANSFER ROLLER

BACKGROUND OF THE INVENTION

1. Field of the Invention

The present invention relates to a exchangeable process cartridge used for forming an image, and an image forming apparatus using this process cartridge, and, more particularly, to a process cartridge for transferring a toner image formed on a latent image carrier onto a sheet, and an image forming apparatus using this process cartridge.

2. Description of the Related Art

Image forming apparatuses, such as a copying machine, a printer and a facsimile, employ a latent image forming type recording apparatus like an electrophotographing apparatus, due to a recent demand for image recording on normal sheets of paper. According to this image forming principle, after a photosensitive drum as a latent image carrier is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper.

The image forming process unit such as a photosensitive drum should be exchanged with a new one since the photosensitive drum has a limited service life and the developer in the developing unit will eventually runs out. Particularly, since this image forming process unit needs to be designed smaller when installed in a compact image forming apparatus, the exchanging cycle becomes short. To facilitate the exchanging operation, the photosensitive drum, the developing unit, etc. are installed in a single cartridge so that they can be handled cartridge by cartridge. It is desirable that even when this process cartridge is exchanged, a toner image can stably be acquired.

FIGS. 1A and 1B are explanatory diagrams of prior art. As shown in FIG. 1A, the image forming apparatus has a process cartridge 160 provided above a sheet cassette 170 for retaining sheets of paper, and a stacker 173 disposed above this process cartridge 160. A U-shaped feeding path 171, which extends from the sheet cassette 170 and reaches the stacker 173 through the process cartridge 160, is formed so that sheets are conveyed along this path 171. This arrangement can prevent the sheet cassette 170 from protruding from the apparatus, thus making it possible to design the apparatus compact. Further, the sheet feeding path 171 can be made short, allowing the apparatus to become more compact. As the feeding path 171 runs vertically, it is easy to remove a jammed sheet.

The process cartridge 160, which is provided in the thus constituted image forming apparatus, has a photosensitive drum 161, a precharger for precharging the photosensitive drum 161, a developing unit for developing an electrostatic latent image on the photosensitive drum 161 with a toner, and a cleaner for removing and collecting the residue toner on the photosensitive drum 161. This process cartridge 160 is exchangeable cartridge by cartridge. Provided at the rear portion of the process cartridge 160 is an optical unit 163 for exposing the photosensitive drum 161 to a laser beam to form an electrostatic latent image thereon. A transfer roller 162 is disposed opposite to the photosensitive drum 161, and discharge rollers 172 are provided on the discharge side of the U-shaped feeding path 171.

A rotatable front cover 180 is provided at the front of the image forming apparatus. As shown in FIG. 1B, this front cover 180 is opened to allow a user to remove a jammed sheet. With the front cover 180 open, the process cartridge 160 can be pulled out so that it can be exchanged with a new process cartridge 160. This method is advantageous because the sheet cassette 170 can be loaded or unloaded from the front side of the apparatus (on the right-hand side of the drawing), and the removal of a jammed sheet and the exchanging of the process cartridge 160 become possible when the front cover 180 is opened.

With this structure, it is effective to use a transfer roller 162 as transfer means for transferring a toner image on the photosensitive drum 161 onto a sheet of paper. The use of a transfer charger is not preferable because the discharging action of the charger deteriorates the photosensitive drum and produces ozone that is harmful to human bodies. In contrast, the transfer roller 162 can transfer the toner image on the photosensitive drum onto a sheet without producing ozone harmful to human bodies and is effective to provide environmental protection.

According to known art, this transfer roller 162 is provided on the front cover 180. The transfer roller 162 performs the image transfer due to the electrostatic force and pressure while abutting on the photosensitive drum 161. The image transfer will not be performed properly unless the transfer roller 162 is accurately positioned opposite to the photosensitive drum 160 (to keep the parallelism and positioning of the shaft). For instance, the improper image transfer may result in improper printing or may cause paper jamming. According to the known art, as the accuracy of the opposing arrangement of the transfer roller 162 depends on the precision of the size of the front cover 180, it is difficult to accurately keep this opposing arrangement. In other words, if the precision of the size of the front cover 180 is improved, the opposing positional relationship between the photosensitive drum 161 and transfer roller 162 can accurately be set. This however requires a severe positional precision of the elongated front cover 180, thus resulting in an increased cost. Further, the opening face (exposed face) of the photosensitive drum 161 in the process cartridge 160 is large. Accordingly, the photosensitive drum 161 can easily be touched by hands or the like, so that the photosensitive drum is likely to be stained with oil or the like or damaged with a foreign matter, thus causing improper printing.

SUMMARY OF THE INVENTION

It is therefore a primary object of the present invention to provide a process cartridge which improves the transfer characteristic of a transfer roller, and an image forming apparatus using this process cartridge.

It is another object of the present invention to provide a process cartridge which can accurately keep the positional opposing relation between a latent image carrier and a transfer roller, and an image forming apparatus using this process cartridge.

It is a further object of the present invention to provide a process cartridge which makes the opening face of a latent image carrier smaller to thereby protect the latent image carrier, and an image forming apparatus using this process cartridge.

To achieve the foregoing and other objects and in accordance with the purpose of the present invention, according to one aspect of the present invention, there is provided a process cartridge comprising a frame; an endless latent image carrier provided on the frame; a charger, provided on the frame, for charging the latent image carrier; and a transfer roller, rotatably provided at that portion of the frame which faces the latent image carrier, for transferring a toner image on the latent image carrier onto a sheet.

According to another aspect of the present invention, there is provided an image forming apparatus which comprises an endless latent image carrier; latent image forming means for forming an electrostatic latent image on the latent image carrier; developing means for developing the electrostatic latent image on the latent image carrier; transfer roller for transferring a toner image on the latent image carrier onto a sheet; and a process cartridge for rotatably supporting at least the latent image carrier on a frame and rotatably holding the transfer roller opposing to the latent image carrier.

According to this invention, as the transfer roller is provided on the process cartridge having the latent image carrier, the positional relationship between the latent image carrier and transfer roller can be secured. Even if the latent image carrier is provided on the process cartridge to be exchangeable, the positional relationship between the latent image carrier and transfer roller can be secured, allowing the transfer roller to perform reliable and good image transfer. Since the above can be accomplished by providing the transfer roller on the process cartridge, the cost can be suppressed low and improper printing, paper jamming, etc. can surely be prevented. Furthermore, since part of the latent image carrier is covered with the transfer roller, the exposed surface of the latent image carrier can be made smaller. Even when the cartridge is loaded into the apparatus or unlocated therefrom, it is possible to reduce accidental contact with the latent image carrier by a user's hand or the occurrence of scratches or the like by a foreign matter.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 2:
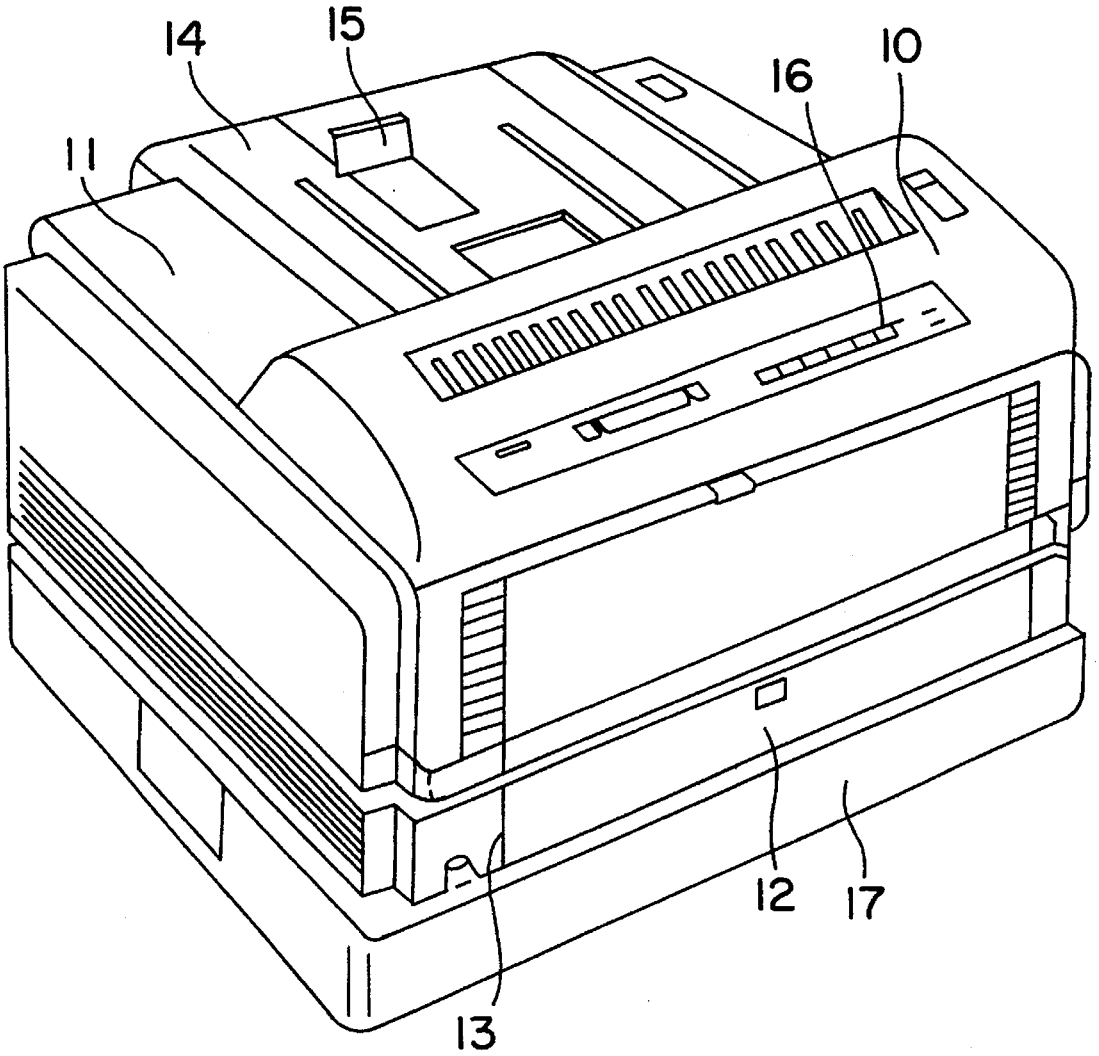
FIG. 2 is a perspective view showing the outline of an image forming apparatus according to one embodiment of the present invention.
Figure 3:
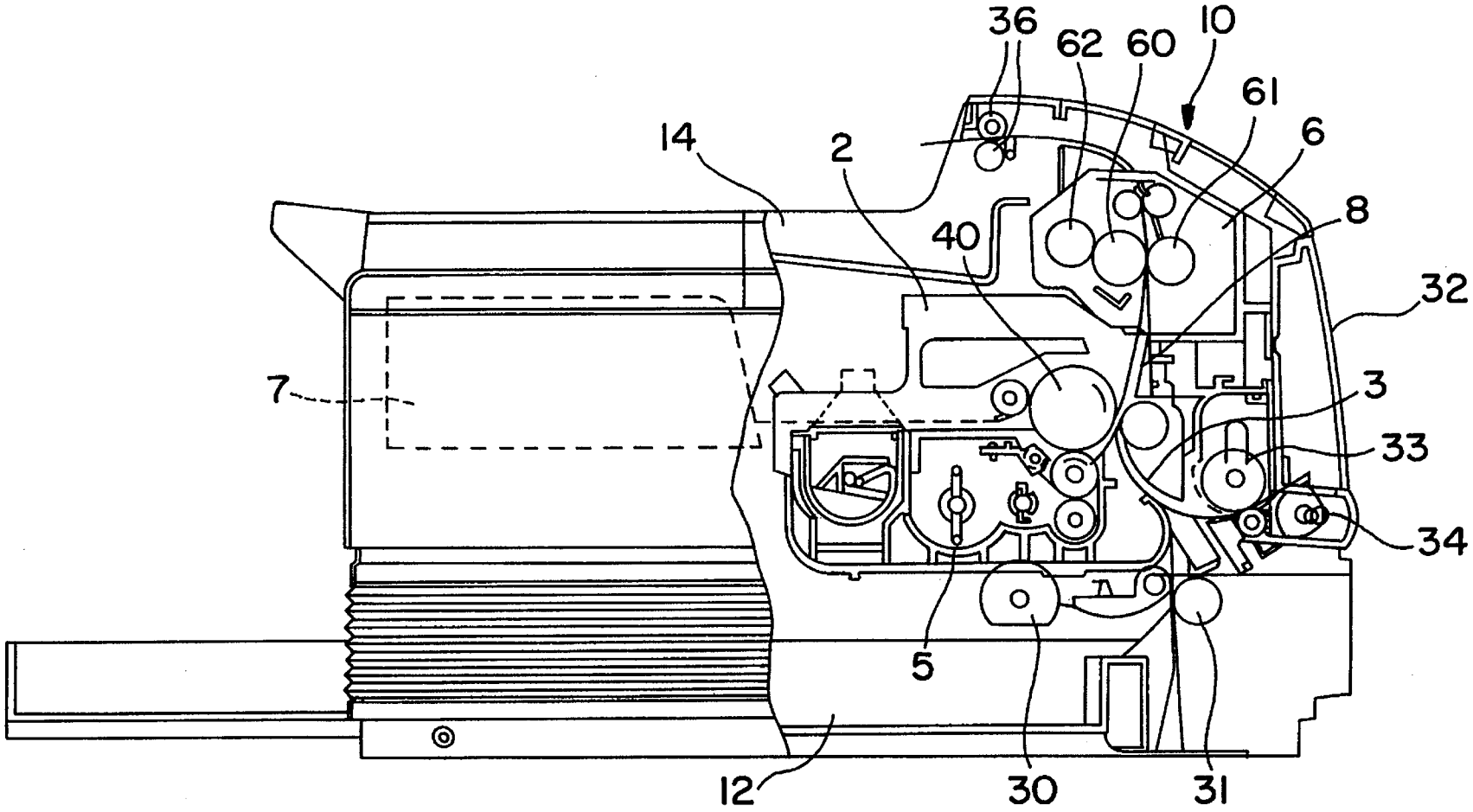
FIG. 3 is a cross-sectional view showing the interior of the image forming apparatus shown in FIG. 2.
Figure 4:
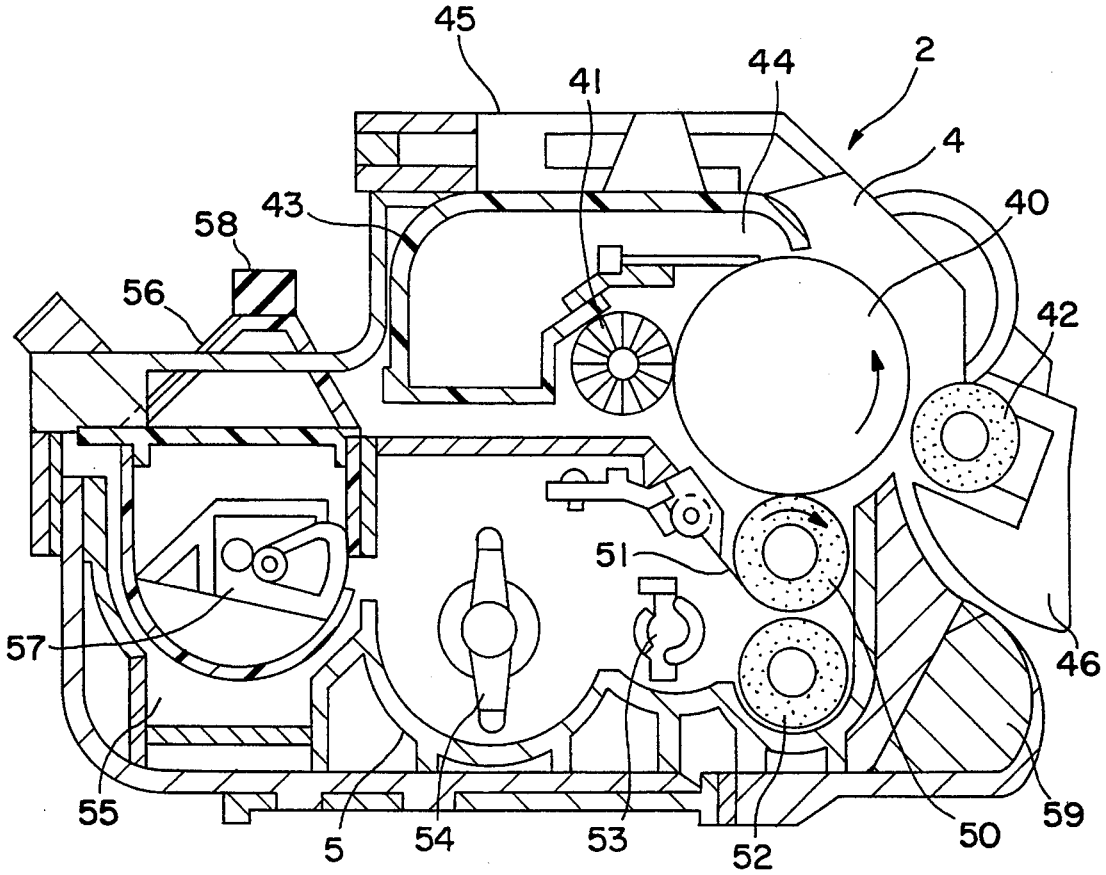
FIG. 4 is a cross section of a process cartridge of the image forming apparatus shown in FIG. 2.
Figure 5:
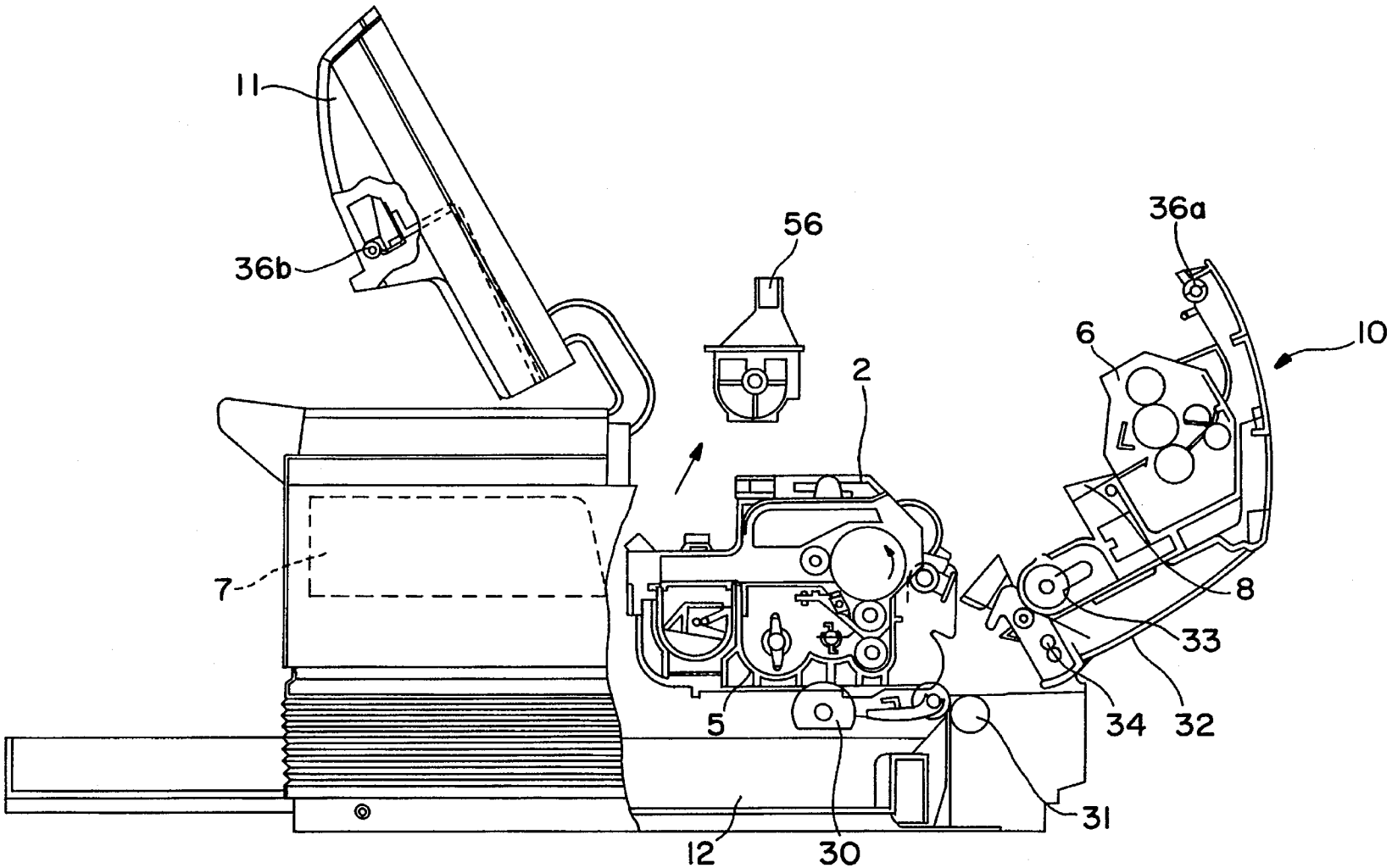
FIG. 5 is a diagram illustrating the image forming apparatus in FIG. 3 with its covers open.
Figure 6A:
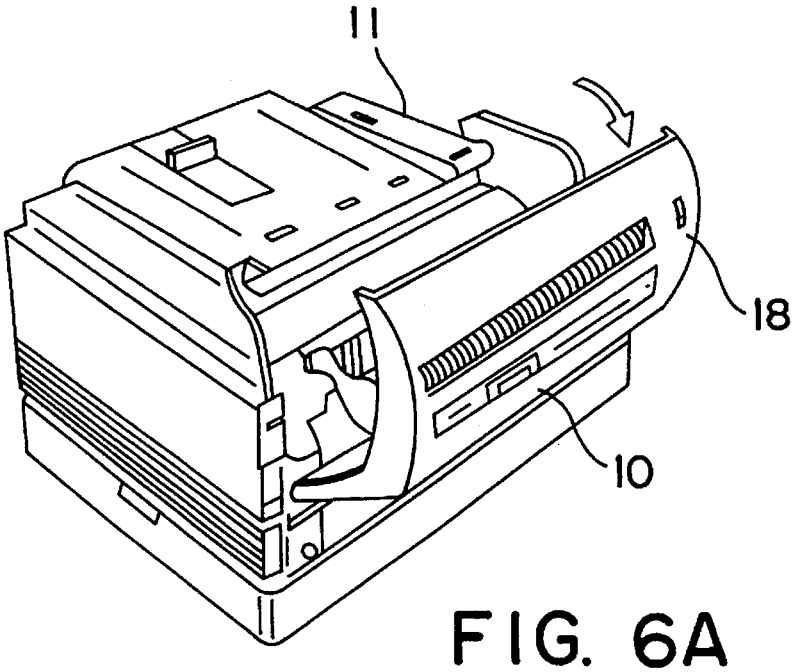
FIGS. 6A and 6B are diagrams illustrating the image forming apparatus shown in FIG. 2 with the covers open.
Figure 6B:
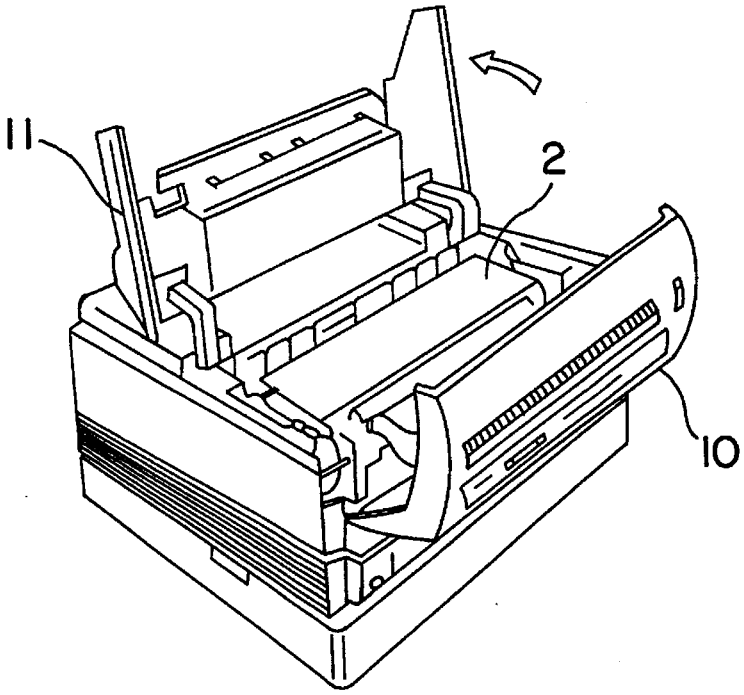
Figure 7:
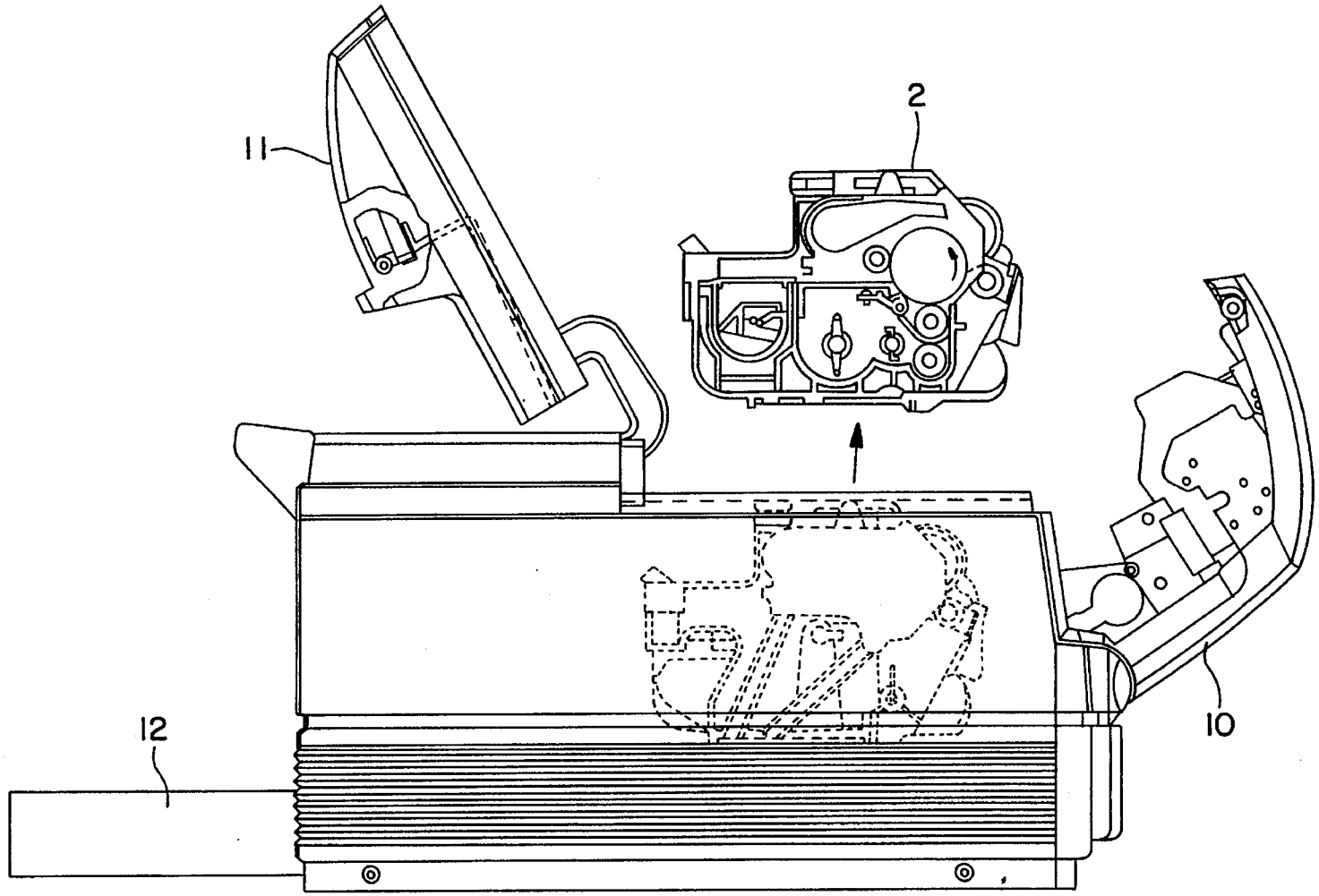
FIG. 7 is a diagram for explaining how to exchange the process cartridge of the image forming apparatus shown in FIG. 3.

FIG. 2 is a perspective view showing the outline of an image forming apparatus according to one embodiment of the present invention, FIG. 3 is a cross-sectional view showing the interior of the image forming apparatus shown in FIG. 2, FIG. 4 presents a cross section of a process cartridge shown in FIG. 3, FIG. 5 illustrates the image forming apparatus in FIG. 3 with its covers open, FIG. 6A is a perspective view of the image forming apparatus with its front cover open, FIG. 6B is a perspective view of the image forming apparatus with its upper cover open, and FIG. 7 illustrates the image forming apparatus with both the front and upper covers open.

The illustrated image forming apparatus is an electrophotographic printer; FIG. 2 is a perspective view of the apparatus as viewed from the front. In FIG. 2, a front cover 10 is opened frontward of the apparatus to open a feeding path 3 shown in FIG. 3. An upper cover 11 covers the top of the apparatus, and is opened upward of the apparatus. When opened, the upper cover 11 opens the top of the apparatus. A sheet cassette 12 is to be set in the apparatus from the front thereof through a cassette inserting port 13. A stacker 14 is provided at the top of the apparatus to receive printed sheets. A sheet guide 15 is provided on the stacker 14 to guide the sheet discharged on the stacker. An operation panel 16 is provided at a front cover 10 and has various switches and a display section. A controller box 17 is provided at the bottom of the apparatus and accommodates printer control circuits, etc.

Referring to the cross-sectional view in FIG. 3, an electrophotographic process cartridge 2 is provided above the sheet cassette 12 and will be described later with reference to FIG. 6. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet. This discharge electrode deelectrifies the back of the sheet to separate the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral "32" denotes a manual-inserting guide 32 which guides a manually inserted sheet to a feeding roller 33 when opened rightward in FIG. 4. The feeding roller 33 feeds the sheet, guided by the manual-inserting guide 32, toward the photosensitive drum 40 of the process cartridge 2. Reference numeral 34 is the rotary shaft of the front cover 10. Discharge rollers 36 are provided at the top portion of the front cover 10 to discharge the sheet, passing through the thermal fixing unit 6, onto the stacker 14.

As shown in the cross-section view in FIG. 4, the process cartridge 2 comprises a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 4, the photosensitive drum 40 has an organic photosensitive layer (OPC or the like) formed on the surface of a cylindrical base of aluminum or the like, and is rotatable counterclockwise as shown. A brush charger 41 is constituted by winding a conductive brush, which has conductive rayon fibers woven into the core, around the rotary shaft. The photosensitive drum 40 is uniformly charged to about −600 V by this brush charger 41. A transfer roller is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box 43 is provided with a scraping blade 44, which scrapes the residue toner off the photosensitive drum 40, so that the box 43 receives the scraped toner. A handle 45 is provided to permit a user to carrying the drum cartridge 4 with a hand. A roller cover 46 serves to be a stopper for the transfer roller 42 and to protect the transfer roller.

The structure of the developing unit 5 will be described next. Referring to FIG. 4, a developing roller 50 is a conductive elastic roller, which is preferably made of a conductive porous rubber material, such as conductive porous polyurethane foam (sponge). The developing roller 50 rotates clockwise as shown in the diagram to feed a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under the conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and supply the toner to the developing roller 50 in the left-hand side of the diagram.

Reference numerals 53 and 54 denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set in the toner cassette retainer 55. A toner supply lever 57 is provided in the toner cassette 56, and rotates to supply the toner in the toner cassette 56 into the developing unit 5. The toner cassette 56 is provided with a handle 58 to allow a user to hold the toner cassette 56 with a hand. A sheet guide rib 59 is provided below the roller cover 46. This sheet guide rib 59, together with the roller cover 46, forms a path for guiding the sheet between the photosensitive drum 40 and the transfer roller 42.

A U-shaped feeding path 3 is formed, which extends from the sheet cassette 12 and reaches the discharge rollers 36 through the process cartridge 2.

The function of this printer will be described referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41 becomes zero, thus forming an electrostatic latent image corresponding to the image to be copied.

As a bias voltage of −300 V is applied to the developing roller 50 in the developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-inserting guide 32 pulled open is likewise conveyed toward the photosensitive drum 40 by the feeding roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

In the diagram of FIG. 5 which illustrates the front cover and upper cover of the apparatus opened, the front cover 10 is opened frontward (rightward in the diagram) around the cover rotary shaft 34. Provided on this front cover 10 are the manual-inserting guide 32, the feeding roller 33, the sheet separator 8, the thermal fixing unit 6 and an upper discharge (drive) roller **36*a* of the discharge roller pair 36. The upper cover 11 is opened upward of the apparatus (upward in the diagram) around a rotary shaft (not shown). A lower discharge (pinch) roller 36*b* of the discharge roller pair 36 is provided on the upper cover 11**.

When the front cover 10 is opened by unlocking a lock lever 18 of the front cover 10, as shown in FIGS. 5 and 6A, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process cartridge 2. Although this design does not open the space between the photosensitive drum 40 and the transfer roller 42, a jammed sheet can easily be removed without any problem even if that portion does not become free.

The reason why the whole thermal fixing unit 6 is provided on the front cover 10 is that if the thermal fixing unit 6 were divided to open the feeding path, a part of the thermal fixing unit should be provided on the process cartridge 2, thus inconveniencing a user to remove the process cartridge 2. Although this design does not open the space between the heat roller 60 of the thermal fixing unit 6 and the backup roller 61, a jammed sheet can easily be removed without any problem even if that portion does not become free.

The front cover 10 is provided above the upper cover 11 at the sheet discharging portion so that the upper cover 11 does not become free unless the front cover 10 is opened as shown in FIG. 2. When the front cover 10 is opened and the upper cover 11 is opened next as shown in FIG. 6B, therefore, the top portion of the apparatus and part of the front portion of the apparatus are opened as shown in FIG. 5. Accordingly, the toner cassette 56 can easily be removed or attached from the front side of the apparatus while keeping the process cartridge 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 7, the attachment and detachment of the process cartridge 2 can also be performed easily. Even if the process cartridge 2 is large, therefore, the exchange of the process cartridge 2 is easy. In other words, the process cartridge 2 can be designed large, particularly, the developing unit 5 in the process cartridge 2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 8:
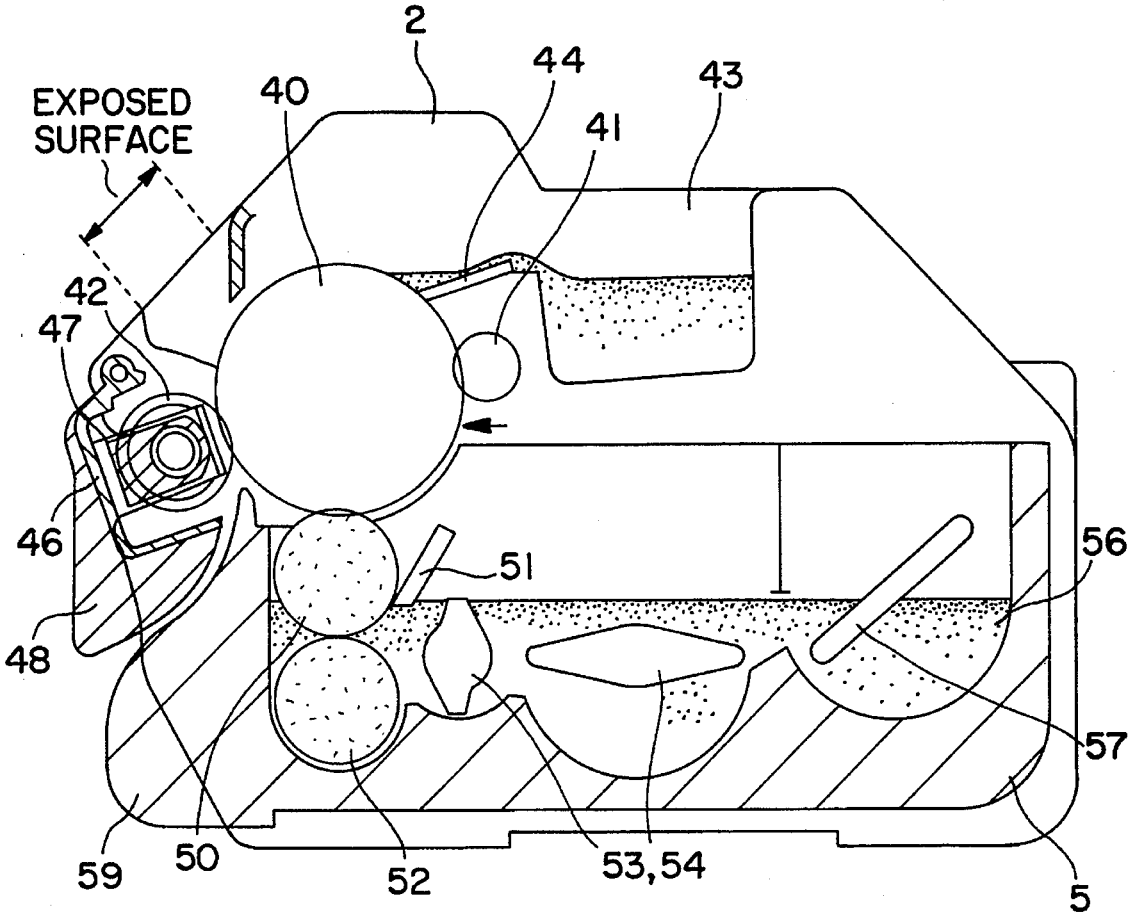
FIG. 8 is a detailed cross section of a process cartridge shown in FIG. 4.
Figure 9:
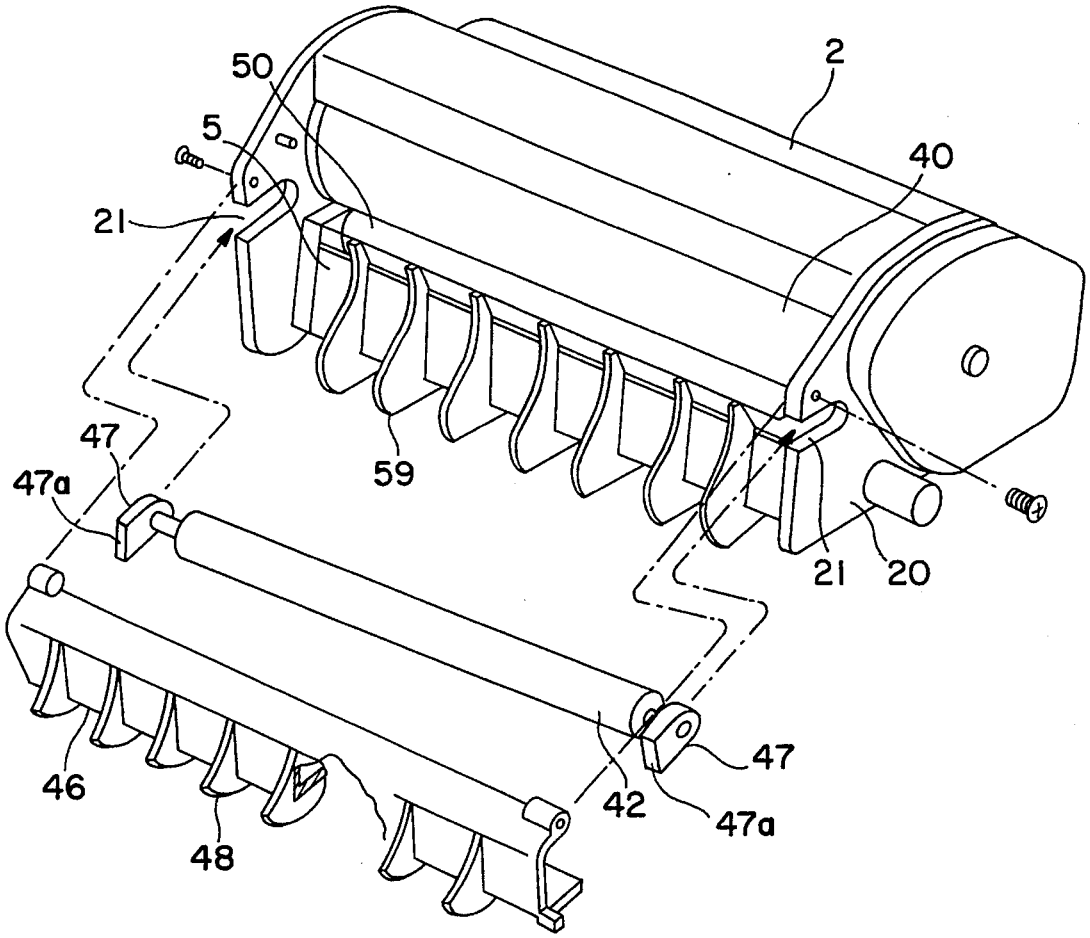
FIG. 9 is an exploded view of the process cartridge shown in FIG. 8.
Figure 10:
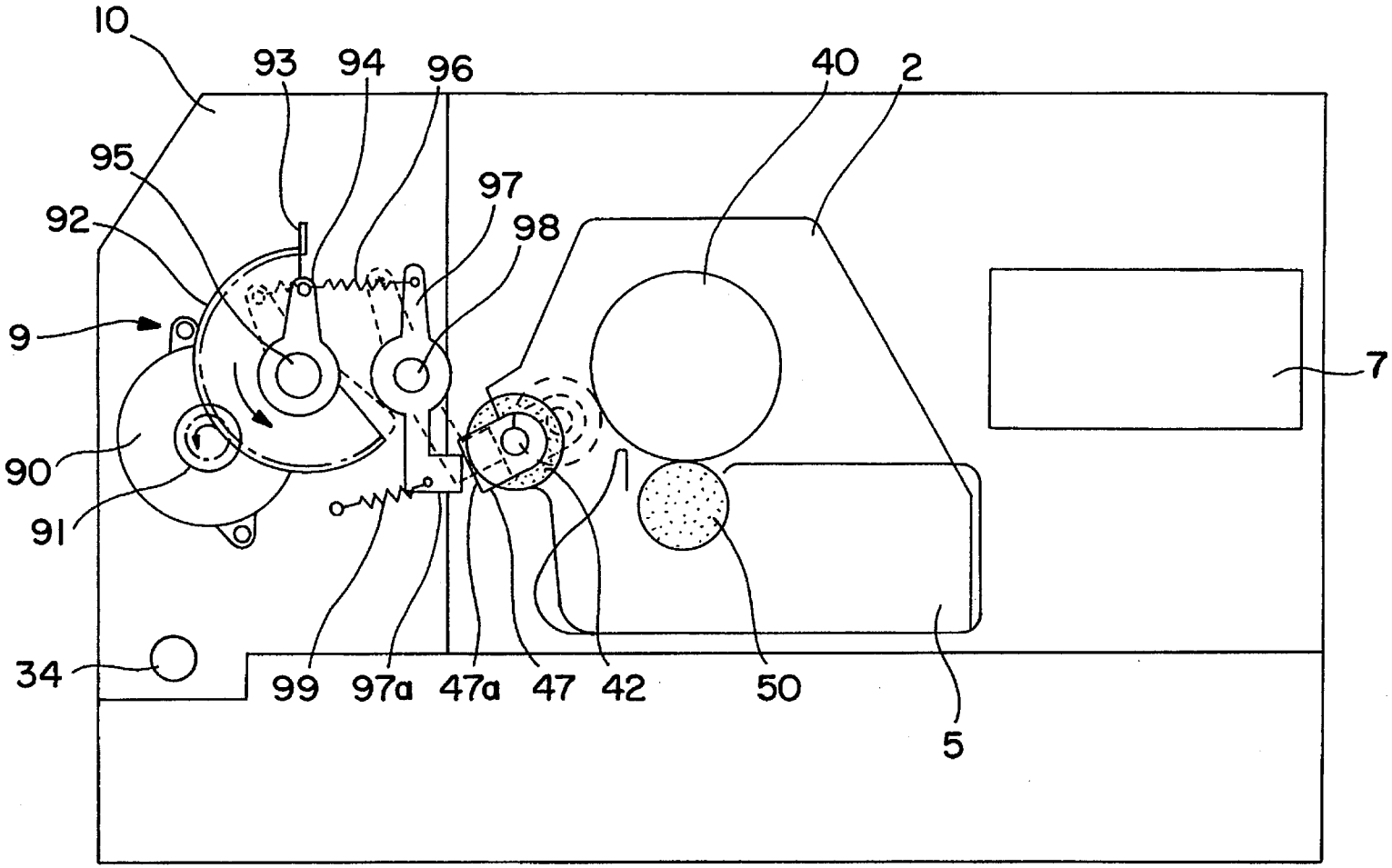
FIG. 10 is a diagram showing the structure of a pressurizing mechanism of the image forming apparatus.

FIG. 8 presents a detailed cross section of the process cartridge shown in FIG. 4, FIG. 9 is an exploded view of the process cartridge shown in FIG. 8, and FIG. 10 is a diagram showing the structure of a pressurizing mechanism of the image forming apparatus.

FIG. 8 illustrates the process cartridge 2 in the structural diagram of FIG. 4 turned left side right. In FIGS. 8 and 9, those shown in FIG. 4 are given the same reference numerals or symbols. In FIG. 9, a unit frame 20 constitutes a frame of the process cartridge 2. The photosensitive drum 40, developing unit 5, charging roller 41, waste toner box 43 and transfer roller 42 are attached to this frame 20. Slide grooves 21 are formed in the frame 20 at predetermined positions with respect to where the photosensitive drum 40 of the frame 20 is to be attached, and serve to slidably hold the transfer roller 42.

Bearings 47 are made of a synthetic resin mold and are fitted on the rotary shaft of the transfer roller 42 at both ends thereof. The bearings 47 also fitted in the slide grooves 21 of the frame 20 in such a way as to be slidable in the slide grooves 21. The bearings 47 each have a flat surface 47*a* formed on the opposite side to the photosensitive drum 40. Reference numeral 46 denotes the aforementioned transfer roller cover, which is attached to the interior of the frame 20 by screws. This transfer roller cover 46 covers the transfer roller 42 and also serves as a stopper for the transfer roller 42. Sheet guide ribs 48 are provided on the transfer roller cover 46 and form, together with the sheet guide ribs 59 of the developing unit 5, a path which guides the sheet from the resist roller 31 (see FIG. 3) between the photosensitive drum 40 and the transfer roller 42.

When the bearings 47 of the transfer roller 42 are fitted in the slide grooves 21 of the frame 20 with the transfer roller cover 46 attached to the frame 20, the resultant structure become as shown in the cross-sectional view in FIG. 8. As the slide grooves 21 are provided at predetermined positions with respect to the position of the attachment of the photosensitive drum 40 of the frame 20, the transfer roller 42 is accurately positioned with the accurate parallelism and positions with respect to the photosensitive drum 40. It is therefore possible to prevent the occurrence of improper image transfer or paper jamming. As the transfer roller 42 has only to be provided on the frame 20 of the process cartridge 2, the positional precision between the photosensitive drum 40 and transfer roller 42 can be improved with an inexpensive and simple structure.

The transfer roller 42 should abut on the photosensitive drum 40. If the transfer roller 42 is kept abutting on the photosensitive drum 40, however, the transfer roller 42 would be thermoplastically deformed. It is therefore necessary to release the abutment of the transfer roller 42 on the photosensitive drum 40 and move the transfer roller 42 away from the photosensitive drum 40 when no image is to be transferred. As the bearings 47 can slide in the slide grooves 21 in this embodiment, the transfer roller 42 can easily be set to abut on or moved away from the photosensitive drum 40. As shown in FIG. 8, the slide grooves 21 are formed askew in the frame 20, the transfer roller 42 can move away from the photosensitive drum 40 by the dead weight.

Further, the provision of the transfer roller cover 46 for the transfer roller 42 can prevent the transfer roller 42 from being stained or scratched by a user's hand. This suppresses the transfer characteristic from being deteriorated. With the transfer roller 42 moved away from the photosensitive drum 40, the transfer roller 42 itself is supported by the transfer roller cover 46, thus preventing the transfer roller 42 from coming out of the process cartridge 2.

Accordingly, the exposed surface of the photosensitive drum 40 becomes narrower as shown in FIG. 8, it is possible to prevent accidental contact with the photosensitive drum by a user's hand, staining the drum with oil or the like, or scratching the drum with a foreign matter. That is, it is possible to prevent the photosensitive characteristic of the photosensitive drum 40 from being deteriorated due to the above causes.

As the transfer roller 42 is provided on the process cartridge 2, part of the transfer roller 42 extends from the process cartridge 2, so that the shape of the process cartridge 2 does not become smart, making it troublesome to handle the process cartridge 2. In this respect, the feeding path from the entrance of the process cartridge 2 to the photosensitive drum 40 is formed as shown in FIG. 8.

Accordingly, that portion of the process cartridge 2 where the transfer roller 42 is provided becomes flat, preventing the transfer roller 42 from protruding and thus facilitating manual handling of the process cartridge 2.

The above is accomplished by providing the sheet guide ribs 59 on the developing unit 5 as well as providing the sheet guide ribs 48 on the transfer roller 46. That is, this design can be accomplished without providing extra components.

The pressurizing mechanism which abuts the transfer roller 42 on the photosensitive drum 40 will be described referring to FIG. 10. In FIG. 10, a pressurizing mechanism 9 is provided on the front cover 10. The structure of the pressuring mechanism 9 will now be described. Reference numeral "90" is a motor which is a drive source for the pressurizing mechanism 9. A drive gear 91 is provided on the shaft of the motor 90. A gear 92 with a shape of a half moon engages with the drive gear 91 and rotates together. A stopper 93 serves to restrict the position of the half-moon gear 92 in the returning direction. A first lever 94 is fitted on a lever shaft 95 of the gear 92, so that the lever 94 rotates together with the gear 92. The lever shaft 95 constitutes the shaft of the gear 92 and the first lever 94 is to be fitted on this lever shaft 95. A spring 96 serves to elastically connect the first lever 94 to a second lever 97 which will be described later. The second lever 97 rotates around a lever shaft 98. Provided at the lower end of the second lever 97 is a pressure block 97*a* for pushing the flat surface 47*a* of the bearing 47 of the transfer roller 42. A return spring 99 urges the second lever 97 in the returning direction.

The function of the pressurizing mechanism will be described below. When the front cover 10 is closed as shown in FIG. 10, the pressure block 97*a* of the second lever 97 abuts on the flat surface 47*a* of the bearing 47 of the transfer roller 42 through the skew slide groove 21 at the retreat position, as indicated by the solid line.

Then, the motor 90 rotates counterclockwise in the arrow direction in the diagram in response to a print instruction. As a result, the drive gear 91 of the motor 90 engages with the half-moon gear 92, rotating this gear 92 counterclockwise. Thus, the first lever 94 provided on the lever shaft 95 is rotated counterclockwise as indicated by the broken line in the diagram. The counterclockwise rotation of the first lever 94 rotates the second lever 97 around the lever 98 via the spring 96. Consequently, the pressure block 97*a* at the lower end of the second lever 97 pushes the flat surface 47*a* of the bearing 47 of the transfer roller 42, causing the transfer roller 42 to abut on the photosensitive drum 40. The pressure of the transfer roller 42 can be adjusted to the desired level by controlling the spring forces of the spring 96 and the returning spring 99.

This permits the transfer roller 42 to perform image transfer so that the toner image on the photosensitive drum 40 can be transferred on a sheet. At this time, the second lever 97 that pushes the transfer roller 42 is connected to the first lever 94 by the spring 96, the repulsive force with a sheet held by the transfer roller 42 is absorbed by the spring 99. Accordingly, the transfer roller 42 can always abut on the photosensitive drum 40 with a uniform pressure.

Because of the flatness of the flat surface 47*a* of the bearing 47 of the transfer roller 42, mechanical contact can surely be made with the pressure block 97*a* the second lever 97. It is therefore possible to uniformly transmit pressure of pressing the transfer roller 42 and to absorb the repulsive force of the transfer roller 42 in the axial direction of the transfer roller 42.

When printing is complete, the motor 90 rotates clockwise in the diagram. Consequently, the drive gear 91 then engages with the half-moon gear 92 to rotate the gear 92 clockwise to the stopper 93, thus returning the first lever 94 provided on the lever 95 to the solid-line position in the diagram. The rotation of the first lever 94 causes the second lever 97 to rotate around the lever shaft 98 via the spring 96. At this time, the second lever 97 is rapidly returned by the returning spring 99. the pressure block 97*a* of the second lever 97 thus returns to the solid-line position in the diagram. Accordingly, the bearing 47 of the transfer roller 42 quickly returns to the retreat position in the grooves 21 due to the dead weight. After printing is complete, therefore, the transfer roller 42 immediately moves away from the photosensitive drum 40 so that it will not be thermoplastically deformed, thus elongating the service life of the transfer roller 42.

As the drive systems 90 and 94 and the second lever 97 are elastically connected by the spring 96, even if the drive system 90–94 are driven at high speed, the transfer roller 42 can be pressed against the photosensitive drum 40 with the proper pressure. Further, since the repulsive force that the transfer roller 42 receives from the sheet can be absorbed by the spring 96, the proper contact pressure can be applied regardless of the thickness of the sheet.

Furthermore, as the transfer roller 42 is quickly returned to the retreat position by the return spring 99, the thermoplastic deformation of the transfer roller 42 can be prevented. In addition, as the gear 92 has the shape of a half moon to prevent its interference with the second lever 97, the distance between the first lever 94 and the second lever 97 can be made narrower. The whole pressurizing mechanism can therefore be made compact, allowing the pressuring mechanism to be retained by the front cover 10.

Since the whole pressurizing mechanism 9 is provided on the apparatus side in this example, no extra mechanism is needed in the process cartridge 2, so that the process cartridge 2 can be designed simpler.

Figure 1A:
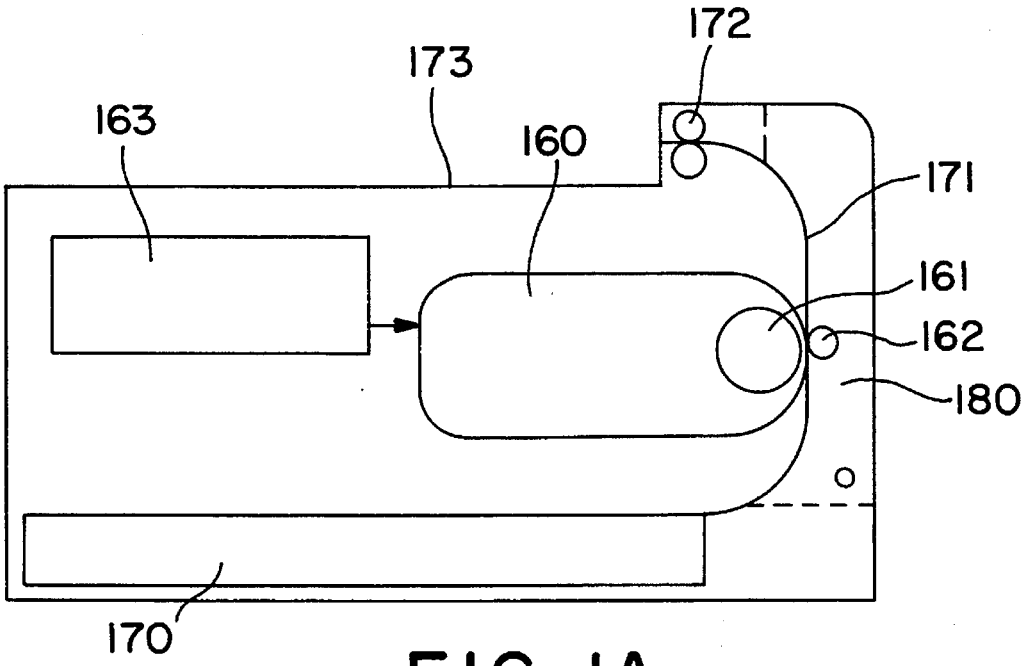
FIG. 1A PRIOR ART
FIGS. 1A and 1B are explanatory diagrams of prior art.
Figure 1B:
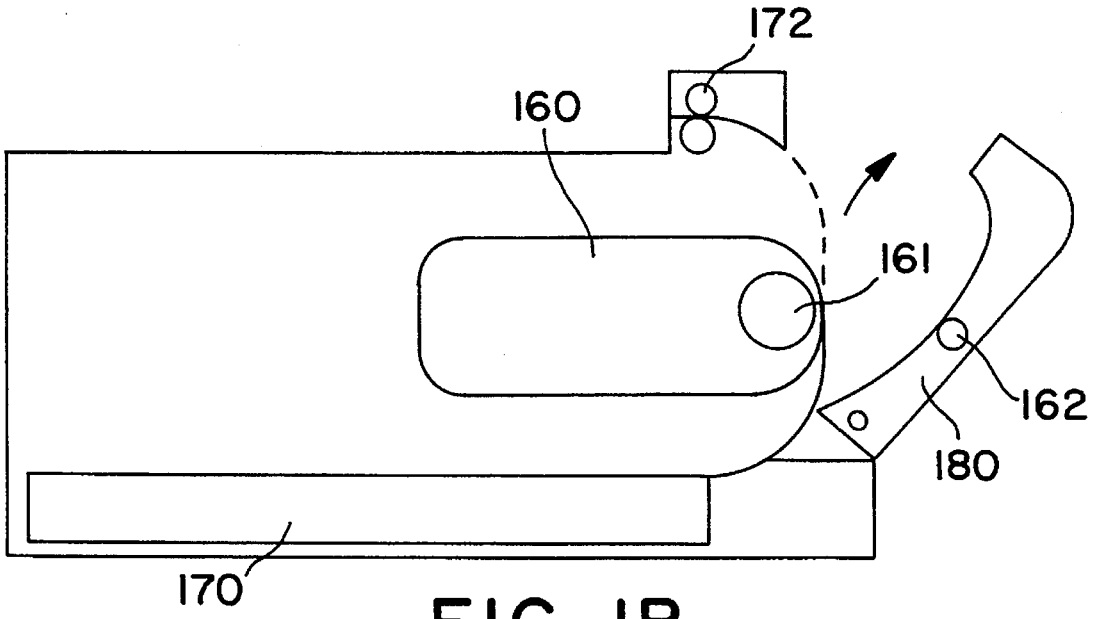
FIG. 1B PRIOR ART
Figure 11:
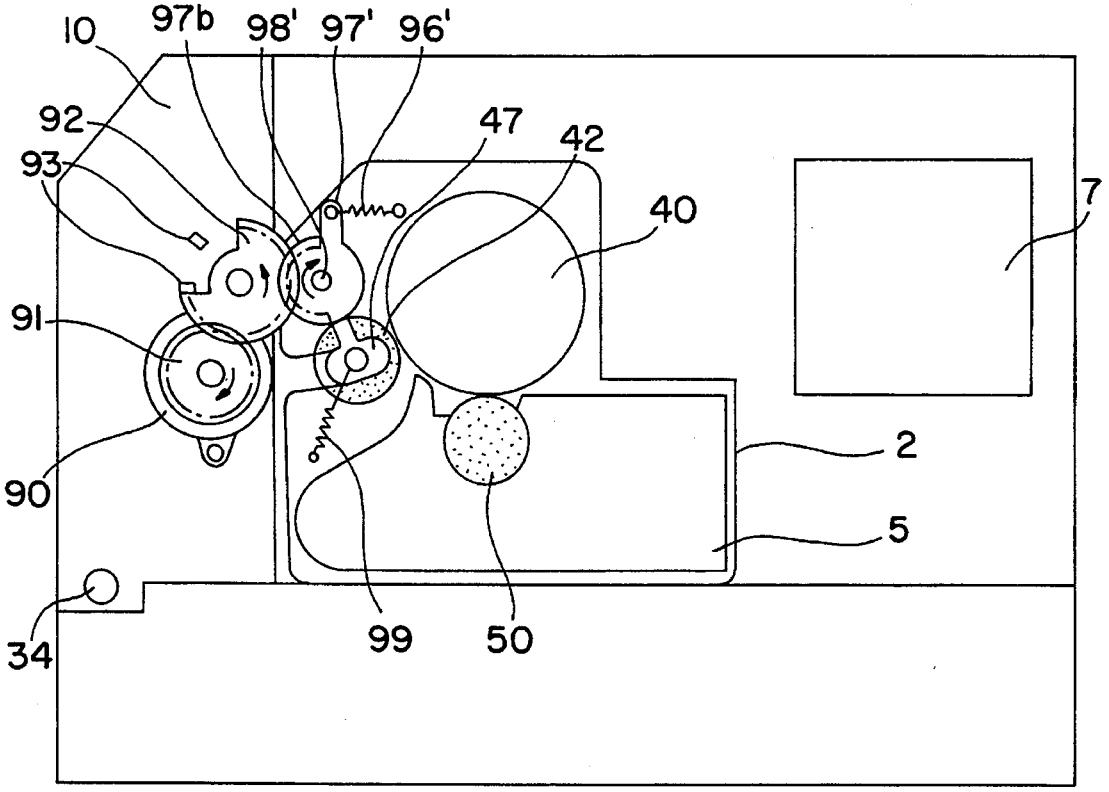
FIG. 11 is a diagram showing another structure of the pressurizing mechanism of the image forming apparatus.

FIG. 11 illustrates the structure of a modification of the pressurizing mechanism. In FIG. 11, those corresponding to or identical to the components shown in FIG. 10 are given the same or like reference numerals. In FIG. 1, a lever 97' is provided on the process cartridge 2 and has its bottom mechanically connected to the bearing 47. This lever 97' has a gear 97*b* which engages with a half-moon gear 92 to rotate around a shaft 98'. A spring 96' serves to urge the lever 97 in the clockwise direction. A return spring 99 is provided at that portion of the lever 97' which is connected to the bearing 47, to rotate the lever 97' clockwise.

In this example, the motor 90 as a drive system, the drive gear 91, half-moon gear 92 and stopper 93 in the pressurizing mechanism 9 are provided on the front cover 10 on the apparatus side. The pressure applying portion of the pressuring mechanism 9 is provided on the process cartridge 2. This pressure applying portion is constituted of the lever 97' having the gear 97*b*, and the springs 96' and 99.

This operation will be described below. The solid line in the diagram indicates where the transfer roller 42 abuts on the photosensitive drum 40. Under this circumstance, when the motor 90 rotates clockwise as indicated by the arrow in the diagram, the drive gear 91 caused the half-moon gear 92 to rotate counterclockwise as indicated by the arrow in the diagram. The lever 97' is therefore rotated clockwise by the gear 97*b*, thus returning the bearing 47 of the transfer roller 42 to the retreat position. At this time, the lever 97' receives the urging force in the returning direction by the return spring 96 provided at the upper portion of the lever 97' and the return spring 99 provided at the lower portion of the lever 97', thus causing the transfer roller 42 to quickly return to the retreat position.

To move the transfer roller 42 to the contact position in response to a print instruction, the motor 90 is rotated counterclockwise, as opposed to the previous case, so that the drive gear 91 rotates the half-moon gear 92 clockwise. This rotates the lever 97' counterclockwise so that the bearing 47 of the transfer roller 42 at the distal end is pressed to thereby abut the transfer roller 42 against the photosensitive drum 40. At this time, the repulsive force of the sheet that is applied to the transfer roller 42 is absorbed by the play in the engagement of the gear 92 with the gear **97*b* of the lever 97'**.

As the pressure applying portion is provided on the process cartridge 2, the opposing position of the pressure block **97*a* of the second lever 97 with respect to the bearing 47 of the transfer roller 42 need not be kept accurately with respect to the opening/closing action of the front cover 10 unlike in the case of FIG. 10. The positional precision of the front cover 10** therefore need not be adjusted severely, so that the apparatus can be manufactured at a lower cost.

In addition to the above modification, the present invention may be modified as follows. First, although the process cartridge 2 has been explained as an electrophotographing mechanism which performs charging, exposure and developing operation in the foregoing description, this invention may be applicable to other types of recording systems, such as a electrophotographic recording system which simultaneously performs the formation of an electrostatic latent image and the developing of this electrostatic latent image or an electrostatic recording system, which transfers a toner image after developing the electrostatic latent image. Further, the type of sheets are not limited to paper, and other media may be used as well. Although the image forming apparatus has been explained as a printer, it may be a different type of image forming apparatus, such as a copying machine or facsimile.

Further, although the driving portion of the pressurizing mechanism is provided on the apparatus side, the driving portion may also be provided on the process cartridge 2 using an actuator such as a plunger magnet. Although the developing unit uses a non-magnetic, one-component developer in the foregoing description, it may use another known type of developer, such as a magnetic, one-component developer or a magnetic, two-component developer.

According to the present invention, since the transfer roller is provided on the process cartridge having a latent image carrier, the opposing positional relationship between the latent image carrier and transfer roller can be defined within the cartridge. The image transfer by the transfer roller can be accomplished efficiently. Further, as the above can be accomplished with a simple structure, the apparatus can be produced at a low cost and improper printing, sheet jamming or other problems can be overcome by the simple structure. Furthermore, since part of the latent image carrier is covered with the transfer roller, the exposed surface of the latent image carrier can be made smaller. Even when the cartridge is loaded into the apparatus or unlocated therefrom, it is possible to prevent accidental contact with the latent image carrier by a user's hand or the latent image carrier from being scratched by a foreign matter.

What is claimed is:

1. An exchangeable process cartridge in an image forming apparatus, comprising:

an endless latent image carrier on which a toner image is formed;

a charger for charging the latent image carrier;

a transfer roller for transferring the toner image from the latent image carrier onto a sheet;

a frame on which said endless latent image carrier and said transfer roller are rotatably provided, said frame having slide grooves by which the transfer roller is slidable in a direction away from a position of contact with said endless image carrier; and a cover for the transfer roller, said cover having guide ribs for guiding the sheet to a nip between the endless latent image carrier and the transfer roller.

2. The process cartridge according to claim 1, further comprising:

bearings, provided at both ends of a rotary shaft of the transfer roller, for rotatably supporting the transfer roller.

3. The process cartridge according to claim 2, wherein the slide grooves are formed askew in the frame.

4. The process cartridge according to claim 3, wherein the bearings each have a flat surface on the opposite side to the latent image carrier.

5. The process cartridge according to claim 2, wherein the slide grooves have open portions which are opposite to the latent image carrier.

6. The process cartridge according to claim 2, wherein the bearings each have a flat surface on the opposite side to the latent image carrier.

7. The process cartridge according to claim 1, further comprising a cleaner, provided on the frame, for removing residue toner from the latent image carrier.

8. The process cartridge according to claim 1, further comprising a developing unit, provided on the frame, for developing an electrostatic latent image on the latent image carrier.

9. The process cartridge according to claim 8, wherein the developing unit includes second guide ribs for forming, together with the guide ribs of the cover, a path to guide a sheet between the transfer roller and the latent image carrier.

10. An image forming apparatus comprising:

an endless latent image carrier;

means for forming an electrostatic latent image on the latent image carrier;

means for developing the electrostatic latent image on the latent image carrier;

a transfer roller for transferring a toner image from the latent image carrier onto a sheet;

a process cartridge having a frame for rotatably supporting the latent image carrier and rotatably holding the transfer roller, said frame having a groove by which the transfer roller is slidable in a direction away from contact with the endless latent image carrier, and having a cover with guide ribs for guiding the sheet to a nip between the endless latent image carrier and the transfer roller;

a main body frame with which the process cartridge is exchangeably provided; and a mechanism, provided on the main body frame, for pressurizing the transfer roller to the endless latent image carrier.

11. The image forming apparatus according to claim 10, further comprising:

bearings, provided at both ends of a rotary shaft of the transfer roller, for rotatably supporting the transfer roller.

12. The image forming apparatus according to claim 11, wherein the slide grooves provided on the frame of the process cartridge are formed askew in the frame.

13. The image forming apparatus according to claim 12, wherein the slide grooves of the process cartridge have portions which are opposite to the latent image carrier which are open.

14. The image forming apparatus according to claim 13, wherein the bearings each have a flat surface on the opposite side to the latent image carrier.

15. The image forming apparatus according to claim 12, wherein the bearings each have a flat surface on the opposite side to the latent image carrier.

16. The image forming apparatus according to claim 11, wherein the slide grooves of the process cartridge have open portions which are opposite to the latent image carrier.

17. The image forming apparatus according to claim 11, wherein the bearings each have a flat surface on the opposite side to the latent image carrier.

18. The image forming apparatus according to claim 17, further comprising a pressurizing mechanism for selectively pressurizing the bearings of the transfer roller to cause the transfer roller of the process cartridge to make contact with and move away from the latent image carrier.

19. The image forming apparatus according to claim 11, further comprising a pressurizing mechanism for selectively pressurizing the bearings of the transfer roller to cause the transfer roller of the process cartridge to make contact with and move away from the latent image carrier.

20. The image forming apparatus according to claim 10, wherein the process cartridge further comprises a cleaner for removing residue toner from the latent image carrier.

21. The image forming apparatus according to claim 10, wherein the process cartridge further comprises a developing unit, provided on the frame.

22. The image forming apparatus according to claim 21, wherein the developing unit of the process cartridge includes second guide ribs for forming, together with the guide ribs of the cover, a path to guide a sheet between the transfer roller and the latent image carrier.

23. An exchangeable process cartridge provided in an image forming apparatus, comprising:

an endless latent image carrier on which a toner image is formed;

a transfer roller for transferring the toner image from said latent image carrier onto a sheet;

a frame on which said image carrier and said transfer roller are rotatably provided, wherein said frame has a groove and the transfer roller slides within the groove in a linear direction away from contact with said endless carrier; and a cover connected to said frame and covering said transfer roller, wherein said cover has a guide rib for guiding the sheet to a nip formed between said endless latent image carrier and said transfer roller.

24. The process cartridge according to claim 23, wherein the groove is open at a remote end from said endless image carrier.

25. An exchangeable process cartridge provided in an image forming apparatus, comprising:

an endless latent image carrier on which a toner image is formed;

a transfer roller for transferring the toner image from said latent image carrier onto a sheet;

a frame on which said image carrier and said transfer roller are rotatably provided, wherein said frame has a groove and the transfer roller slides within the groove in a linear direction away from contact with said endless carrier; and a cover connected to said frame and covering said transfer roller, wherein said transfer roller has bearings provided at both ends of said transfer roller, the bearings being slidably fitted in the groove, and wherein said cover has a guide rib for guiding the sheet to a nip formed between said endless latent image carrier and said transfer roller.

26. An image forming apparatus comprising:

an endless latent image carrier;

latent image forming means for forming a latent image on the latent image carrier;

developing means for developing the latent image from the latent image carrier into a toner image;

a transfer roller for transferring the toner image on the latent image carrier onto a sheet;

a process cartridge having a frame for rotatably supporting at least the latent image carrier and rotatably holding the transfer roller, wherein said process cartridge includes a cover for said transfer roller;

a main body frame within which the process cartridge is exchangeably provided; and a mechanism, provided on the main body frame, for pressurizing the transfer roller in a linear direction towards the endless latent image carrier;

wherein said cover has a guide rib for guiding the sheet to a nip formed between said endless latent image carrier and said transfer roller.

27. The process cartridge according to claim 26, wherein said transfer roller has bearings provided at both ends of said transfer roller, the bearings being slidably fitted in the groove.

28. An exchangeable process cartridge provided in an image forming apparatus comprising:

an endless latent image carrier on which a toner image is formed;

a transfer roller for transferring the toner image on said latent image carrier onto a sheet; and a frame on which said image carrier and said transfer roller are rotatably provided, wherein said frame has a groove and the transfer roller slides within the groove by dead weight in a linear direction away from contact with said endless carrier.

29. The exchangeable process cartridge according to claim 28, further comprising:

a motor proving drive; and a power lever connected to the rotatable lever by a tension member, wherein the power lever controls rotation of the rotatable lever in response to the drive of the motor.

30. The exchangeable process cartridge according to claim 28, further comprising:

a shaft at a center of the transfer roller which slidably engages with the frame along the groove.

* * * * *

UNITED STATES PATENT AND TRADEMARK OFFICE

CERTIFICATE OF CORRECTION

PATENT NO. : 5,606,406

DATED : February 25, 1997

INVENTOR(S) : Takuzou IKEYAMA et al.

It is certified that error appears in the above-indentified patent and that said Letters Patent is hereby corrected as shown below:

Col. 14, line 53, change "proving" to --providing--.

Signed and Sealed this

Tenth Day of June, 1997

*Attest:*

Bruce Lehman

BRUCE LEHMAN

*Attesting Officer*

*Commissioner of Patents and Trademarks*